United States Patent [19]

Weiss

[11] Patent Number: 4,723,331

[45] Date of Patent: Feb. 9, 1988

[54] FITTED SHEET WITH TAPERED BOTTOM WIDTH PANELS

[75] Inventor: Sidney M. Weiss, New York, N.Y.

[73] Assignee: Sleep-Knit International, Greenwich, Conn.

[21] Appl. No.: 891,303

[22] Filed: Jul. 28, 1986

[51] Int. Cl.[4] ..... A47G 9/02; A47C 23/00

[52] U.S. Cl. ..... 5/497; 5/495; 5/498; 5/499

[58] Field of Search ..... 5/497, 495, 499, 498, 5/482

[56] References Cited

U.S. PATENT DOCUMENTS

| | | | |
|---|---|---|---|
| 1,315,593 | 9/1919 | Binder | 5/497 |
| 3,114,156 | 12/1963 | Cobb | 5/497 |
| 3,142,072 | 7/1964 | Goodson, Jr. | 5/497 |
| 3,181,179 | 5/1965 | Roddey, Jr. | 5/497 |
| 3,273,175 | 9/1966 | Anderson et al. | 5/497 |
| 3,638,251 | 2/1972 | Weiss | 5/497 X |
| 3,789,441 | 2/1974 | Weiss | 5/497 |
| 3,962,739 | 6/1976 | Crockett | 5/497 |
| 4,192,032 | 3/1980 | Geraci | 5/497 |
| 4,308,626 | 1/1982 | Weiss | 5/497 X |

*Primary Examiner*—Alexander Grosz
*Assistant Examiner*—Carl M. DeFranco, Jr.
*Attorney, Agent, or Firm*—Brumbaugh, Graves, Donohue & Raymond

[57] ABSTRACT

A fitted sheet is formed with material that is tapered in width between the side edges, so that the material is wider between the side edges, at the mid point between the top and bottom edges, and narrower in regions closer to the top and bottom edges.

4 Claims, 7 Drawing Figures

FITTED SHEET WITH TAPERED BOTTOM WIDTH PANELS

BACKGROUND OF THE INVENTION

This invention relates to fitted bed covers, and particularly to fitted sheets which are fabricated out of knitted fabrics having stretch characteristics.

My prior U.S. Pat. No. 3,789,441 describes and claims a fitted sheet which is devoid of elastic edges and formed of two-way stretch fabric. Sheets of this invention are widely used in health care institutions and are available in many sizes, ranging from fitted sheets for bassinet mattresses through conventional size hospital mattresses, and even for water mattresses. In other categories, these fitted sheets range from bunk-size mattresses for naval facilities to king-size mattresses for home and hospitality use.

My U.S. Pat. No. 4,308,626 describes and claims a fitted top sheet which is currently in wide use in hospitals and other institutions.

In connection with the use of fitted sheets, particularly fitted bottom sheets, the use of thicker than standard mattresses in health care institutions, as well as for home and hospitality use, and the burgeoning growth of the use of mattress pads (toppings), ranging in thickness from 1" to 4½" which are applied to the top-side of mattresses to promote better skin care, i.e., to reduce the occurrence of bed sores, have created a need for a multiplicity of sheet sizes to accommodate the varying dimensions of said mattresses and the toppings used thereon. By way of example, in nursing home facilities, generally, the mattresses used vary in width from 36" to 39", in length from 75" to 78" and in thickness from 5" to 7". Where a topping is used, the thickness can be increased by as much as 4½". Furthermore, hospitals generally use mattresses that are 36" in width and from 80" to 84" in length. While one bottom fitted sheet in accordance with the invention of my U.S. Pat. No. 3,789,441 can accommodate these sizes, today, with health care institutions having widely adopted the use of toppings, one size of said fitted sheet no longer fits all said mattresses. This fact has resulted in the need to provide a wide range of different sheet sizes to fit these over-sized and over-thick mattress sizes, including mattresses having different thicknesses. Within any given health care institution, this situation creates both inventory and housekeeping problems, as well as increased costs due to the need to maintain a large inventory of different sheet sizes to accommodate the many different mattress sizes.

The present invention makes it possible to provide one fitted sheet for all of the mattress sizes utilized today in health care facilities, as well as home and hospitality uses. It follows logically that fewer stock items means less inventory and less inventory expense; the avoidance of purchasing errors; and the elimination of confusion at both the housekeeping and nursing levels.

Furthermore, in connection with the use of fitted sheets, particularly fitted bottom sheets in hospitals and health care institutions and to a lesser degree in home and hospitality use, it has been noted that when sheets are mounted to over-sized mattresses or over-thick mattresses, i.e., those provided with "toppings", excess stretching of the sheets can often cause the sheet side edge to be released from under the mattress so that the mattress or undercovers become visible. This situation is aesthetically undesirable.

Additionally, it has been found that when the fitted bottom sheets of my U.S. Pat. No. 3,789,441 are used with mattress having toppings or with an over-sized mattresses, there can result excess stress on the sheet itself, particularly the bound edges thereof, which can result in premature tearing of the sheet.

It is therefore an object of the present invention to provide a new and improved fitted sheet having improved resistance against lifting of the side edges from below a mattress; improved performance on oversized mattresses or over-thick mattresses, e.g. those having toppings; improved resistance to tearing; and to provide the means for reducing the number of items in inventory by reason of the ability of this invention to accommodate various sizes, lengths, widths and thicknesses, of mattresses.

SUMMARY OF THE INVENTION

The present invention relates to a fitted bedcover formed from a generally rectangular piece of material with a top edge, a bottom edge and two side edges, and having four fitted corners formed by a cut-out of the rectangular piece at the junction of two edges where cut edges are joined to form the fitted corners. In accordance with the invention there is provided an improvement wherein the piece of material is tapered in width and has its greatest width between the side edges near the mid point between the top and bottom edges.

In the preferred embodiment of the invention the cut-outs are formed by the junction of two arcs, each approximately 90°. A first arc originates with one of said top or bottom edges, and the other arc smoothly mates with a curved side edge.

Preferably, the side edges are approximately 4 to 12 inches wider at the center than in the region adjacent the fitted corners.

For a better understanding of the present invention together with other and further objects, reference is made to the following description taken in conjunction with the accompanying drawings, and its scope will be pointed out in the appended claims.

DESCRIPTION OF THE INVENTION

Figure 1:
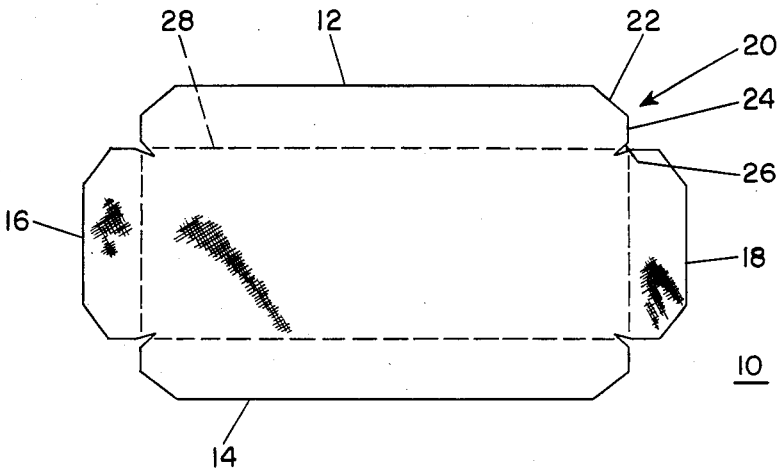
FIG. 1 (PRIOR ART)
FIG. 1 is a cutting pattern for a fitted sheet in accordance with the prior art.
Figure 2A:
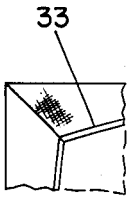
FIG. 2A is a detail view of FIG. 2.

FIG. 1 shows a pattern for making a bottom sheet in accordance with the invention of my U.S. Pat. No. 3,789,441. The FIG. 1 illustration shows a generally rectangular piece of material 10 having side edges 12 and 14, a bottom edge 16 and a top edge 18. Shown dotted in FIG. 1 is an outline 28 representing the size of a mattress that the sheet will be used on. Each corner 20 of the material 10 is provided with cut-outs having edges 22, 24 and 26 which progressively form a curve from the side edge 12 to an apex facing inwardly from the corner. Similar multi-segment cut-outs are formed at each corner. The cut-out edges may also be curved as illustrated in my U.S. Pat. No. 3,789,441. The cut segments 22, 24 and 26 are sewn together at seam 32 to form fitted corners as shown in FIG. 2 and usually there is provided a hem or other binding 33 of the same fabric around the remaining edges as shown in FIG. 2A.

Figure 2:
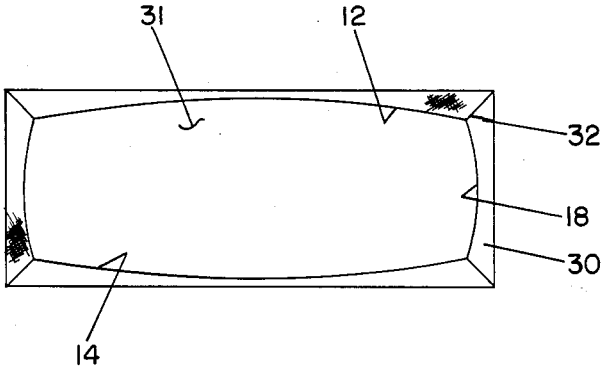
FIG. 2 (PRIOR ART)
FIG. 2 is a bottom view of a mattress with a prior art fitted sheet mounted thereon.
Figure 3:
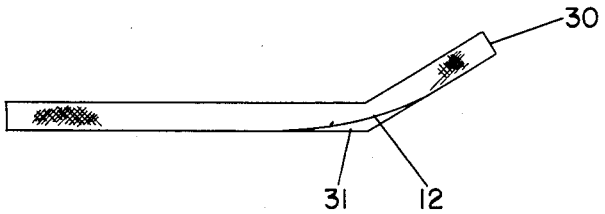
FIG. 3 (PRIOR ART)
FIG. 3 is a side view of a mattress having a fitted sheet in accordance with the prior art, wherein a portion of the mattress is elevated.

It has been observed that when the sheet 30 of my prior patent is placed upon a mattress, the tension applied to the two-way stretch fabric used therein, particularly the tension in the length direction, causes a reduction in the width of the sheet near the central section as illustrated in FIG. 2. The tension which arise in the two-way stretch fabrics cause the sheet side edges 12 and 14 to be pulled outwardly toward the edges of the bottom of mattress 31. In extreme cases, the side edges of the fitted sheet may come away from below the mattress, particularly in hospital applications, wherein the mattress 31 may be partially folded to elevate a patient, as illustrated in FIG. 3. FIG. 3 shows the sheet 30 on mattress 31 in an elevated condition wherein side edge 12 has disengaged from the bottom of sheet 31 causing a side portion of mattress 31 to be visible.

The stretching problem becomes more acute when sheets are used on an over-sized mattress or a mattress provided with toppings. In this case the sheet tension becomes greater and the tendency for disengagement becomes greater. In addition use of the sheet with excess tension can cause the sheet to tear, particularly when the user increases tension along the side edges 12, 14 by sitting on the bed.

Figure 4:
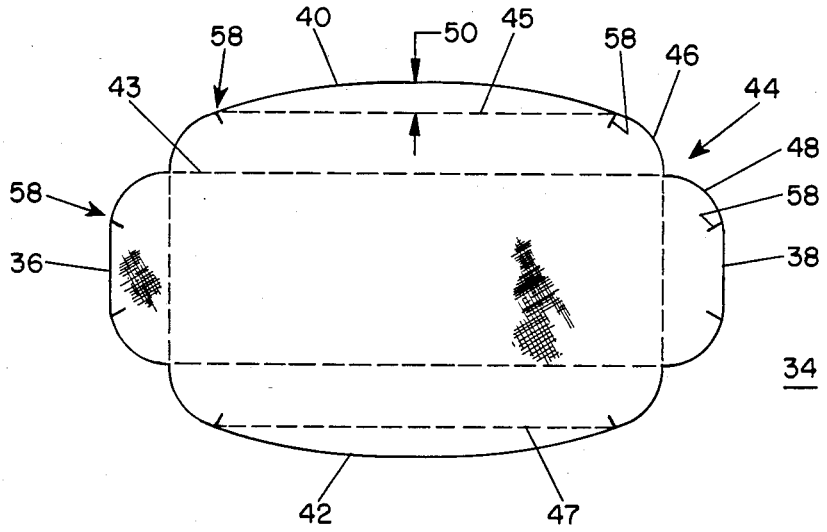
FIG. 4 is an illustration of a pattern for a sheet in accordance with the present invention.

FIG. 4 is a pattern for a fitted bottom sheet in accordance with the present invention. A generally rectangular piece of material 34, preferably two-way stretch knitted material, is provided with bottom edge 36, top edge 38 and side edges 40 and 42. Dotted line 43 illustrates the general size of a mattress top which the sheet is intended to cover. Dotted lines 45 and 47 illustrates the nominal position of the side edges 12 and 14 as sheets were constructed in accordance with the prior art. The corners 44 of material 34 are cut with arcs 46 and 48. In the preferred embodiment illustrated, curve 48 is circular and extends 90° from the nominal corner position of mattress outline 43 to top edge 38. Similar curves are provided at each corner with respect to the top and bottom edges of material 34. Curve 46 is similarly circular over most of its length which is slightly less than 90°, but blends smoothly with curved side edge 40. As illustrated, side edge 40 is tapered having a relatively large radius of curvature. Side 40 is arranged so that the width of material 34 between edge 40 and edge 42 at the central portion of material 34 (between edges 36 and 38) is larger than the width adjacent curves 46 near the corners. The additional width 50 for each side edge is approximately 2 to 6 inches, so that the central width between side edges 40 and 42 is approximately 4 to 12 inches greater than the nominal width represented by lines 45 and 47.

Figure 5A:
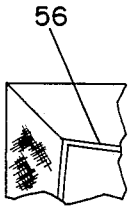
FIG. 5A is a detail view of FIG. 5.

As in the prior art fitted sheets, the cut edges 46 and 48 of corners 44 are sewn together as far as markers 58 to form a fitted sheet. A binding 56 may be provided as shown in FIG. 5A. As formed, there is naturally excess material near the center of the side edges which provides the advantages of the present invention as illustrated in FIG. 5.

Figure 5:
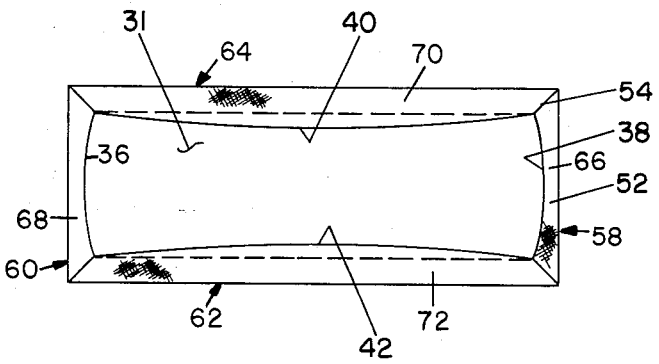
FIG. 5 is a bottom view of a mattress with the sheet of the present invention mounted thereon.

When the corner cut-outs are sewn directly together a fitted sheet 52 as shown in FIG. 5 is formed. Sheet 52 includes a rectangular upper panel, formed from the portion of material within dotted line 43 in FIG. 4, a head panel 58, foot panel 60 and side panels 62 and 64. The fitted sheet also includes a bottom head panel 66 with free edge 38, a bottom foot panel 68 with free edge 36 and side panels 70, 72 with respective free edges 40 and 42. As shown from the bottom view of FIG. 5 free edges 36, 38, 40 and 42 collectively form a continuous boundary of a lower opening of the fitted sheet 52 and preferably have a continuous binding 56 along the continuous boundary. Because of the shape of material piece 34, as illustrated in FIG. 4, bottom side panels 70 and 72 are continuously tapered in width to have a greater panel width near the center of the sheet than near the fitted corners. Accordingly, edges 40 and 42 have an unstretched length which is greater than the straight line distance between the fitted corners.

When a sheet 52 having fitted corners 54 formed by sewing edges 46 and 48 is mounted to a mattress 31 the side edges, 40 and 42 have sufficient excess width at the center so that in the stretched condition the edges lie approximately on, or perhaps inwardly of lines joining the junction of the side edges and the top and bottom edges at the fitted corners. This excess width provides resistance to disengagement of the side edge of the fitted sheet when applied to an over-sized mattress and/or over-thick mattress, e.g., those having toppings. The excess material also assists in keeping the fitted sheet on the mattress when a patient's bed is elevated. It will be recognized that the curved nature of the side edges provides excess length for relief of stress resulting from vertical stretching of the bottom sheet on a mattress thereby lessening the tendency of the sheet to tear when used on an over-sized mattress.

While there has been described what is believed to be the preferred embodiment of the present invention, those skilled in the art will recognize that other and further modifications may be made thereto without departing from the spirit of the invention, and it is intended to claim all such improvements as fall within the true scope of the invention.

I claim:

1. A fitted bedcover for covering a mattress, comprising a piece of knitted stretch fabric, said piece having cut edges sewn directly together to form four fitted corners, said bedcover including a rectangular top panel, a head end and a foot end panel, and, two side panels for covering a top surface, a head end and a foot end surface, and two side surfaces, respectively, of said mattress, with adjacent edges of said end and said side panels being connected together to form said fitted corners for extending around the four corner edges of said mattress, said bedcover further including a bottom head panel, a bottom foot panel, and two bottom side panels extending from respective bottom edges of said head end panel, foot end panel, and two side panels, and for projecting inwardly underneath and against a bottom surface of said mattress, with adjacent edges of said bottom panels being connected directly together to form said fitted corners, said bottom side panels having excess width portions for extending further inwardly underneath and against said bottom surface of said mattress, said bottom head, bottom foot, and bottom side panels each having a free edge, said free edges collectively forming a continuous boundary having a continuous edge binding attached thereto, said excess portions of said bottom side panels being continuously tapered in width from said connected adjacent edges of said bottom panels to a greatest width point near the center of said bottom side panels between said head and foot panels, said continuous boundary having an excess length along said tapered excess portion to allow said bedcover to fit over a large size range of mattresses and mattress toppings, and to relieve stress which occurs along said continuous edge binding of said bedcover.

2. The improvement specified in claim 1 wherein said piece of material comprises knitted two way stretch material.

3. The improvement specified in claim 1 wherein said excess portion tapers are curved in shape and said curved excess portions blend smoothly into said cut edges of said fitted corners.

4. The improvement specified in claim 3 wherein said cut edges of said corners are circular in shape.

* * * * *